US007559780B2

(12) United States Patent
Mizoguchi et al.

(10) Patent No.: US 7,559,780 B2
(45) Date of Patent: Jul. 14, 2009

(54) LEVER-TYPE CONNECTOR

(75) Inventors: Atsushi Mizoguchi, Yokkaichi (JP); Masaya Horiuchi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/176,437

(22) Filed: Jul. 21, 2008

(65) Prior Publication Data

US 2009/0023317 A1 Jan. 22, 2009

(30) Foreign Application Priority Data

Jul. 19, 2007 (JP) ..... 2007-187925

(51) Int. Cl.
*H01R 13/62* (2006.01)

(52) U.S. Cl. ..... 439/157

(58) Field of Classification Search ..... 439/152, 439/160, 372

See application file for complete search history.

(56) References Cited

U.S. PATENT DOCUMENTS 5,401,179 A * 3/1995 Shinchi et al. ..... 439/157
5,709,560 A * 1/1998 Hio ..... 439/157
6,679,711 B2 * 1/2004 Takahashi ..... 439/157

* cited by examiner

*Primary Examiner*—Briggitte R Hammond
(74) *Attorney, Agent, or Firm*—Gerald E. Hespos; Anthony J. Casella

(57) ABSTRACT

A lever-type connector (10) has a housing (60) for engaging a mating connector (80). A lever (20) is supported rotatably by the housing (60) and is configured for assisting connection of the connectors (10, 80). The lever (20) has a lever-locking part (31) with a deformable elastic piece (33). A lock (35) on the elastic piece (33) engages a receiving portion (72) on the housing (60) for holding the lever (20) in a rotation-prevented state. A release portion (41) formed separately from the lever-locking part (31) can be pressed to displace the elastic piece (33) in a direction for separating the lock (35) from the receiving portion (72).

8 Claims, 9 Drawing Sheets

LEVER-TYPE CONNECTOR

BACKGROUND OF THE INVENTION

1. Field of the Invention

The invention relates to a lever-type connector.

2. Description of the Related Art

U.S. Pat. No. 7,172,442 discloses a lever-type connector that has a housing configured for fitting to a mating connector and a lever supported rotatably on the housing. The lever has an operation part and arms that project from opposite ends of the operation part. Thus the lever is U-shaped and is mounted to straddle the housing. Each arm has a cam groove for engaging a cam pin on the mating connector. The lever is rotated while the cam pin engages the cam groove to produce a cam action for moving the connector and the mating connector towards one another.

The arm of the lever has a lever-locking part for holding the lever in a rotation-prevented state when the lever has finished a rotation. The lever-locking part has an elastic piece with a fixed end and a free end that is elastically deformable around the fixed end. A lock is formed on the elastic piece and can be locked to a receiving portion on the housing by flexing the elastic piece. A release portion is disposed at the free-end and can be pressed to unlock the lock from the receiving portion.

The components of the lever-locking part are arranged in a row from the fixed end to the release portion in the rotational direction of the lever. Thus, the lever-locking part is large. The distance from the fixed end to the lock can be shortened to make the entire lever-locking part compact. However, it then is impossible for the lock to obtain a necessary flexure for locking the lock to the lever-locking part-receiving portion. Further it is difficult for an operator to put fingers on the release portion.

The invention has been completed in view of the above-described situation. Therefore it is an object of the invention to provide a lever-type connector with a compact lever-locking part that can be operated smoothly.

SUMMARY OF THE INVENTION

The invention relates to a lever-type connector with a housing for engaging a mating connector. A lever is supported rotatably by the housing and has a cam groove for engaging a cam pin on a mating connector. The cam groove and the cam pin display a cam action when the lever is rotated, and the cam action causes the housing to approach the mating connector. The lever has a lever locking part for holding the lever in a rotation-prevented state when the lever finishes its rotation. The lever-locking part has a fixed end and an elastic piece that is elastically deformable around the fixed end. A lock is formed on the elastic piece and is spaced from the fixed end. The lock can lock to a receiving portion on the housing or on the mating connector. A release portion is disposed between the fixed end and the lock and is configured to cover the lock. The release portion can be pressed towards the lock to flex the elastic piece and to disengage the lock from the receiving portion.

The release portion of the lever-locking part is interposed between the fixed end and the lock. Thus, it is possible to shorten the entire length of the lever-locking part, as compared with the case where the fixed end, the lock and the release portion are arranged in a row. The distance between the fixed end and the lock is long. Therefore, a sufficient flexure amount of the elastic piece can be achieved when the lock is locked to the receiving portion.

The lever preferably has an arm and an operation part at the end of the arm. The cam groove is formed in the arm and the operation part is configured to be held by the operator's fingers for operating the lever. The lever-locking part preferably is on the operation part. The fixed end preferably is at one end of the operation part in a rotational direction thereof, and the lock preferably is at other end of the operation part in the rotational direction thereof. As a result, it is possible to obtain sufficient flexure of the elastic piece and a favorable feeling in the locking operation without making the lever large.

The release portion preferably is not connected to the elastic piece. However, an interlocking portion is between the elastic piece and the release portion and flexes the elastic piece in an unlocking direction when the release portion is pressed. Thus, the elastic piece is flexed smoothly and the release portion and the elastic piece are designed with a high degree of freedom.

DETAILED DESCRIPTION OF THE PREFERRED EMBODIMENTS

Figure 1:
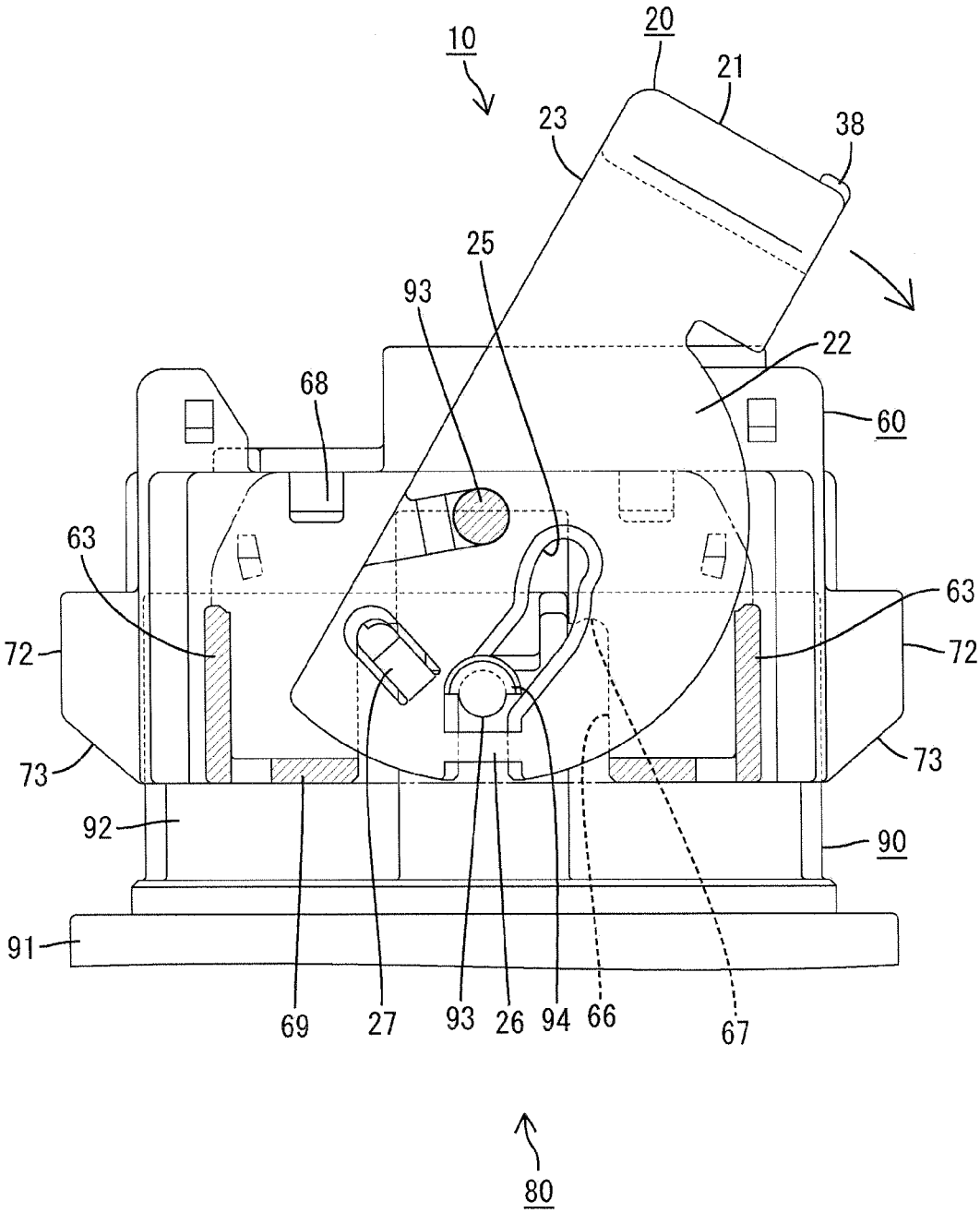
FIG. 1 is a side view, partly in section, showing a lever held at an initial rotational position, and a connector housing fit in a mating connector.

A lever-type connector in accordance with the invention is identified by the numeral 10 in FIGS. 1 through 4. The connector 10 has a lever 20, a housing 60, and terminal fittings (not shown). The lever 20 can be rotated to fit the housing 60 in a mating connector 80 or to separate the housing 60 therefrom. In the following description, the end at which the housing 60 is fit in the mating connector 80 is referred to as the front.

Figure 9:
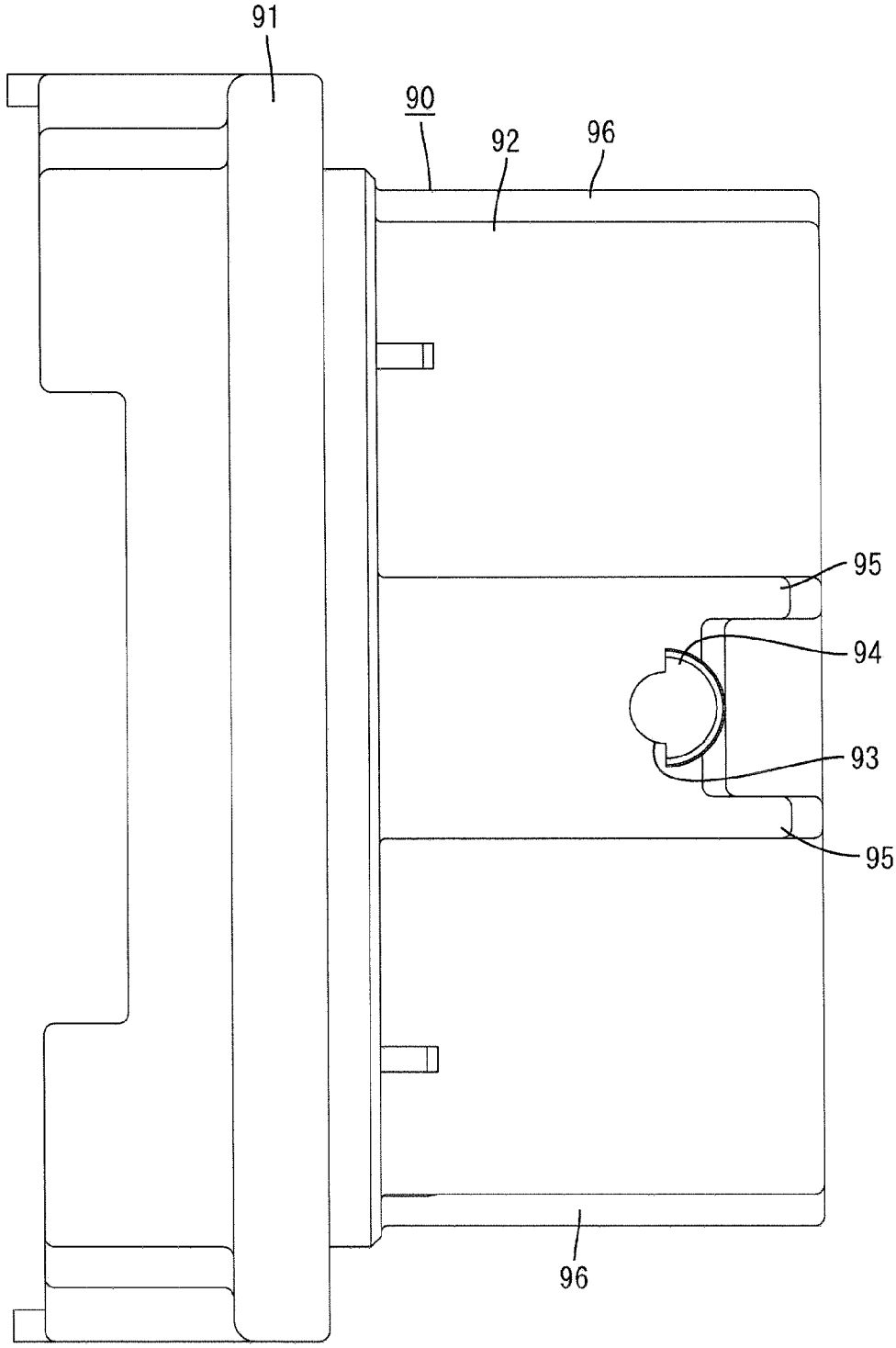
FIG. 9 is a side view of the mating housing.

The mating connector 80 is constructed as a male connector and has a mating housing 90 made of synthetic resin. The mating housing 90 has a terminal accommodation part 91, as shown in FIG. 9. A wide rectangular hood 92 projects forward from the terminal accommodation part 91 and is open at the front end. Male terminal fittings (not shown) of different sizes are mounted in the terminal accommodation part 91 and front ends of the terminal fittings project into the hood 92.

Upper and lower cam pins 93 project at a widthwise center of both upper and lower surfaces (longer-side surfaces) of the hood 92. A flange 94 projects from the leading end of each cam pin 93 and extends around a front half of the circumference of the cam pin 93. Left and right release ribs 95 project from the upper and lower surfaces of the hood 92 at both sides of the cam pin 93 for releasing a temporary holding state of the lever 20 at an initial rotational position of the lever 20. Left and right guide ribs 96 extend longitudinally at left and right side surfaces (shorter-side surfaces) of the hood 92.

Figure 5:
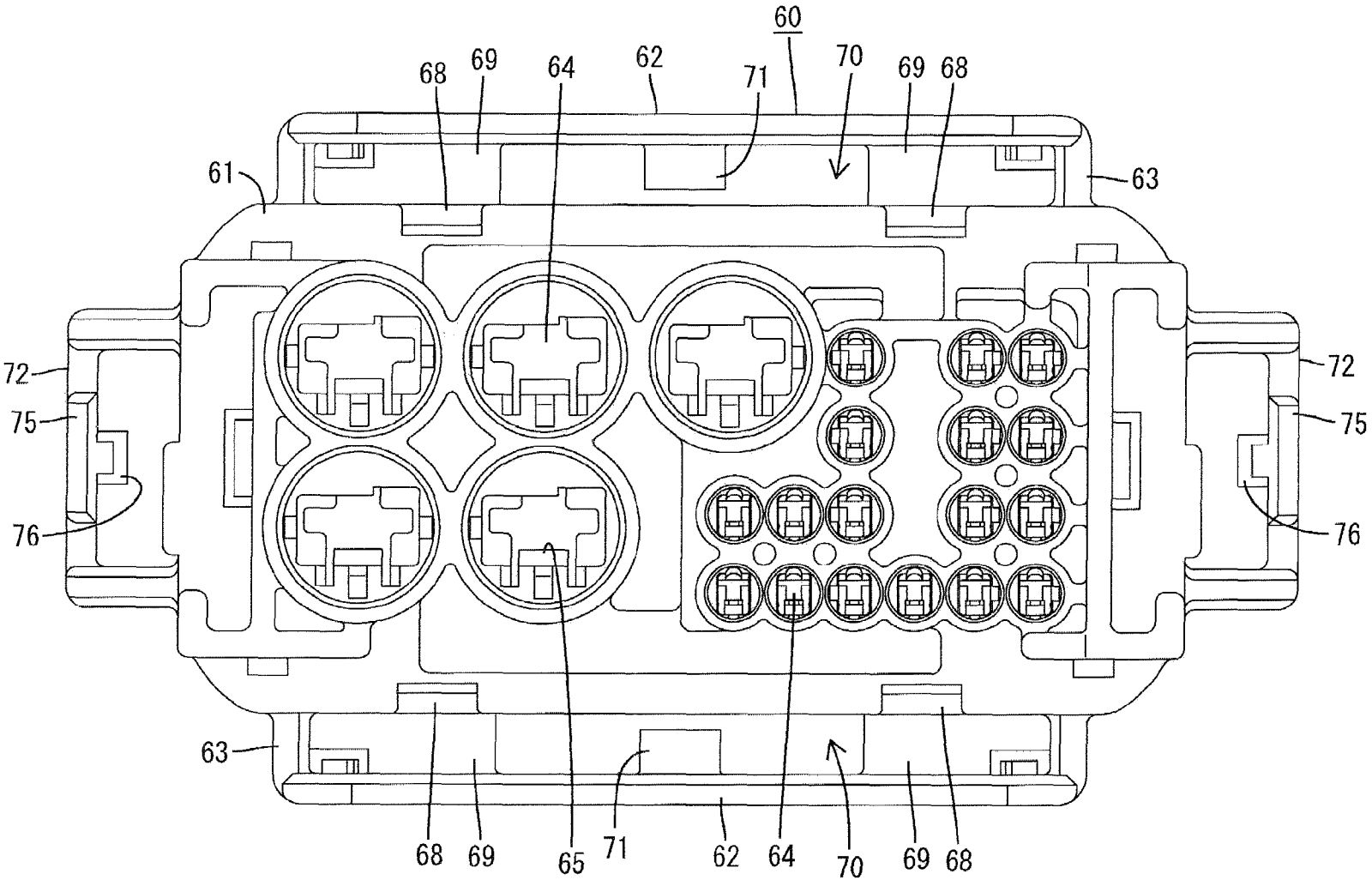
FIG. 5 is a rear view of the housing.
Figure 6:
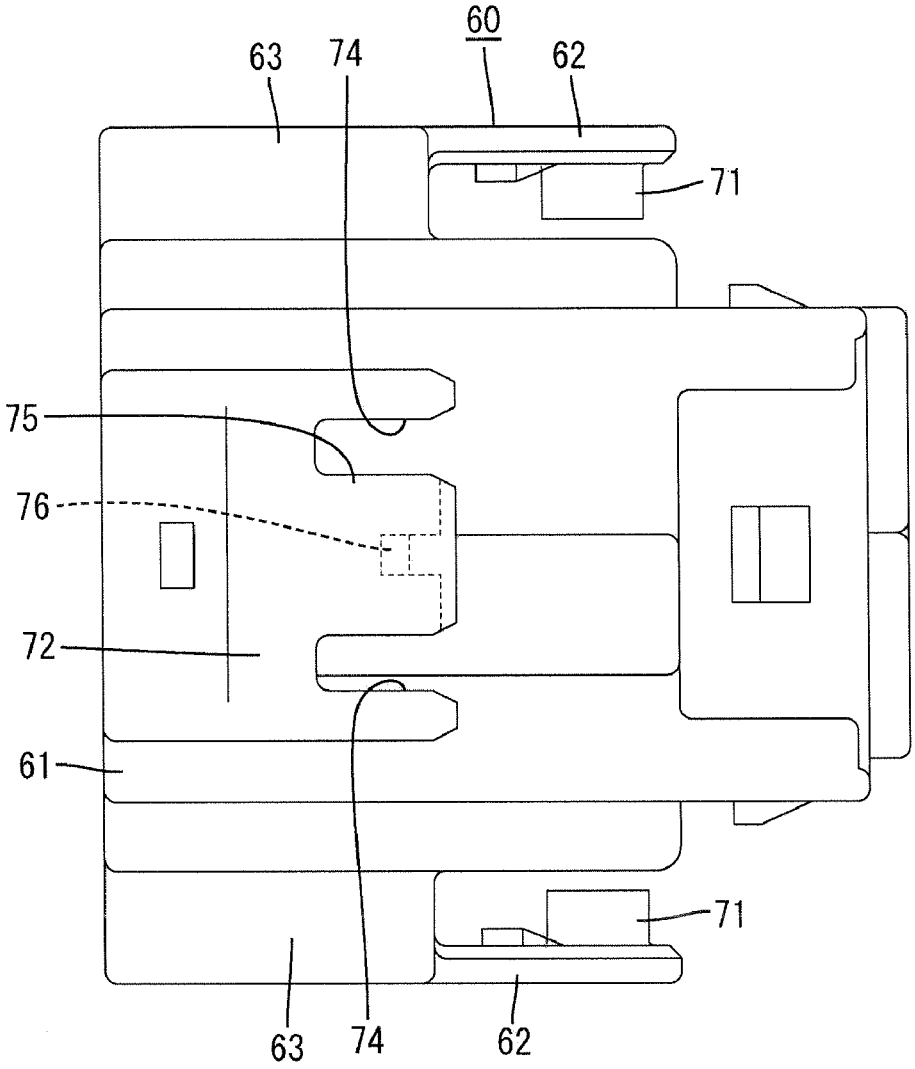
FIG. 6 is a side view of the housing.

The housing 60 is constructed as a female housing and is made of synthetic resin. As shown in FIGS. 5 and 6, the housing 60 has a block-shaped main body 61. Upper and lower covering walls 62 are spaced at an interval from the respective upper and lower surfaces (longer-side surfaces) of the main body 61. Connection walls 63 connect both side edges of the covering wall 62 to both respective side edges of the main body 61. The main body 61 has cavities 64 for accommodating female terminal fittings therein. The cavities 64 are formed in different sizes in correspondence to different sizes of the terminal fittings. More specifically, small cavities 64 for small terminal fittings are disposed at the right part of FIG. 5, whereas large cavities 64 for large terminal fittings are disposed at the left part of FIG. 5. A lance 65 is formed on an inner wall of each cavity 64 for preventing the removal of the terminal fitting therefrom.

As shown in FIG. 1, a receiving groove 66 is formed by cutting out central portions of front ends of the upper and lower surfaces of the main body 61 for receiving the cam pin 93. A step 67 is defined in the receiving groove 66 and locks to part of the lever 20 when the lever 20 is at the initial rotational position. Concavities 68 are formed at both sides of a rear end of the upper and lower surfaces of the main body 61 and receive a part of the lever 20 when the lever 20 is at a rotation-finish position.

Lever accommodation spaces 70 are disposed between the main body 61 and the covering wall 62 to accommodate parts of the lever 20. Each lever accommodation space 70 penetrates the housing 60 longitudinally and is capable of receiving a cam pin 93 of the mating connector 80 from the front. Left and right walls 69 are connected with connection walls 63 for closing an open front portion of the lever accommodation space 70 except a move-in passage for the cam pin 93. Upper and lower shafts 71 project at a widthwise center of an inner surface of the covering wall 62 and rotatably support the lever 20. Each shaft 71 is approximately columnar and is disposed rearward from a rear end of the connection wall 63.

Left and right receiving portions 72 are provided on left and right side surfaces (shorter-side surfaces) of the main body 61 for holding the lever 20 in a rotation-prevented state when the lever 20 has reached the rotation-finish position. Each receiving portion 72 defines a rearwardly open box that defines a trapezoid in side view with a sloped front end 73. Upper and lower slits 74 (see FIG. 6) are formed at a rear end of each receiving portion 72 and a rearwardly cantilevered receiving piece 75 is defined between the slits 74 of each receiving portion 72. A receiving projection 76 projects from the free rear end of the receiving piece 75. The provision of the left and right receiving portions 72 at left and right sides of the housing 60 enables the lever 20 to be mounted for rotation either clockwise or counterclockwise in accordance with space and other considerations.

Figure 7:
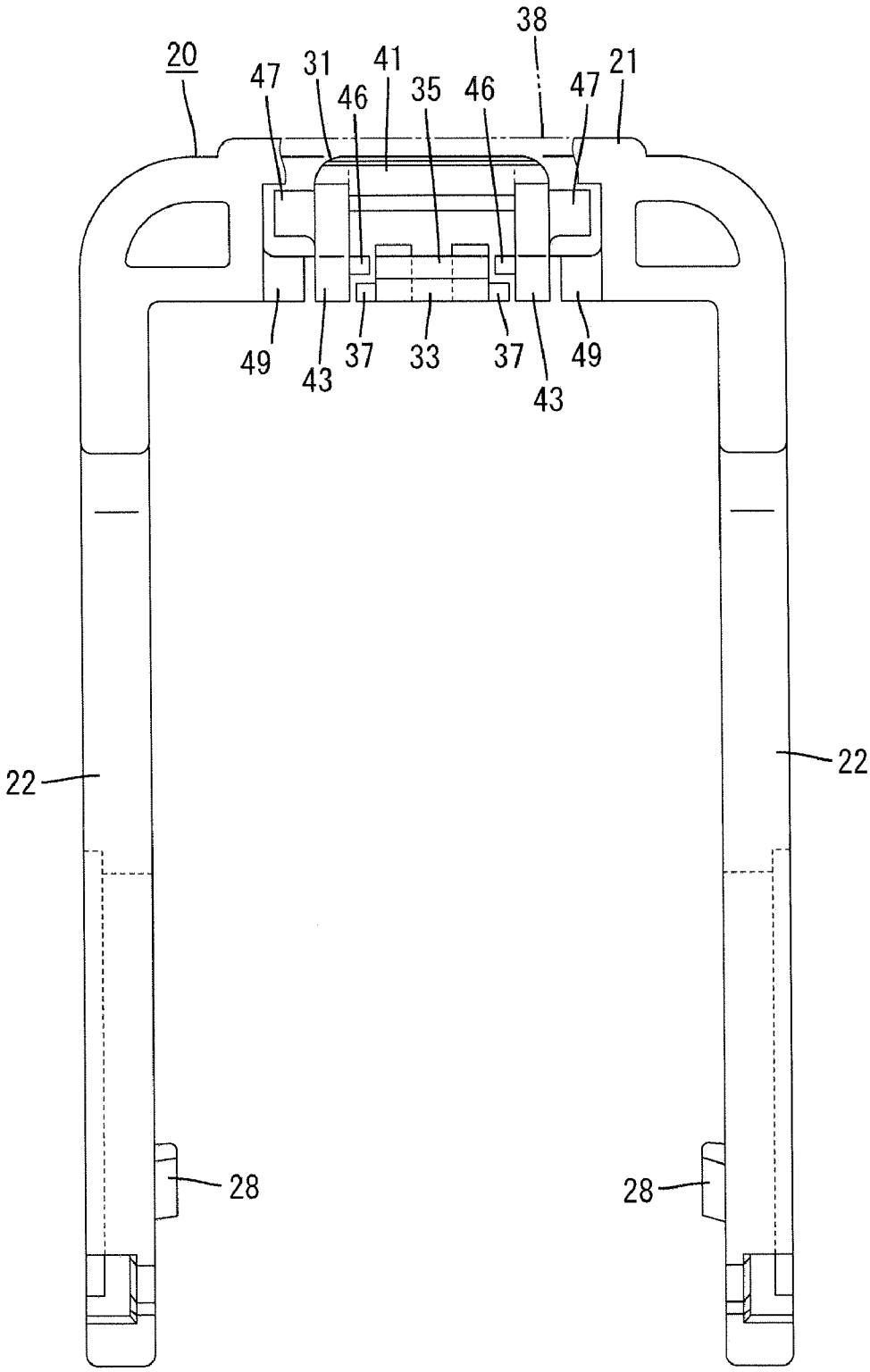
FIG. 7 is a front view of the lever.

The lever 20 also is made of synthetic resin. As shown in FIG. 7, the lever 20 has an operation part 21 and parallel arms 22 that project from opposite ends of the operation part 21. Thus, the lever is substantially U-shaped. The lever 20 is rotatable between an initial rotational position shown in FIG. 1 and a rotation-finish position shown in FIG. 2. A straight edge 23 is formed at the rear of the lever 20 in a direction in which the lever 20 rotates from the initial position to the finish position (see FIG. 1). The straight edge 23 is approximately horizontal and parallel to the front end of the housing 60 when the lever 20 is at the rotation-finish position (see FIG. 2).

Each arm 22 is plate-shaped and has a bearing 24 (see FIGS. 2 through 4) spaced from the operation part 21. The shafts 71 of the housing 60 can be inserted into the respective bearings 24 to support the lever 20 rotationally. Each arm 22 further includes a cam groove 25 spaced out from the bearing 24. Each cam groove 25 extends in a predetermined direction and opens on the periphery of the respective arm 22. The cam pins 93 move into the respective cam grooves 25 and engage the cam grooves 25. A bridge 26 (FIG. 1) is formed at an entrance of the cam groove 25. Each arm 22 further includes a holding piece 27 spaced from the bearing 24 and the cam groove 25. Each holding piece 27 is cantilevered in the rotational direction of the lever 20 and is capable of flexing resiliently in and out. A holding projection 28 (see FIG. 7) projects in from the leading end of the holding piece 27 and is capable of engaging the corresponding release rib 95.

Figure 8:
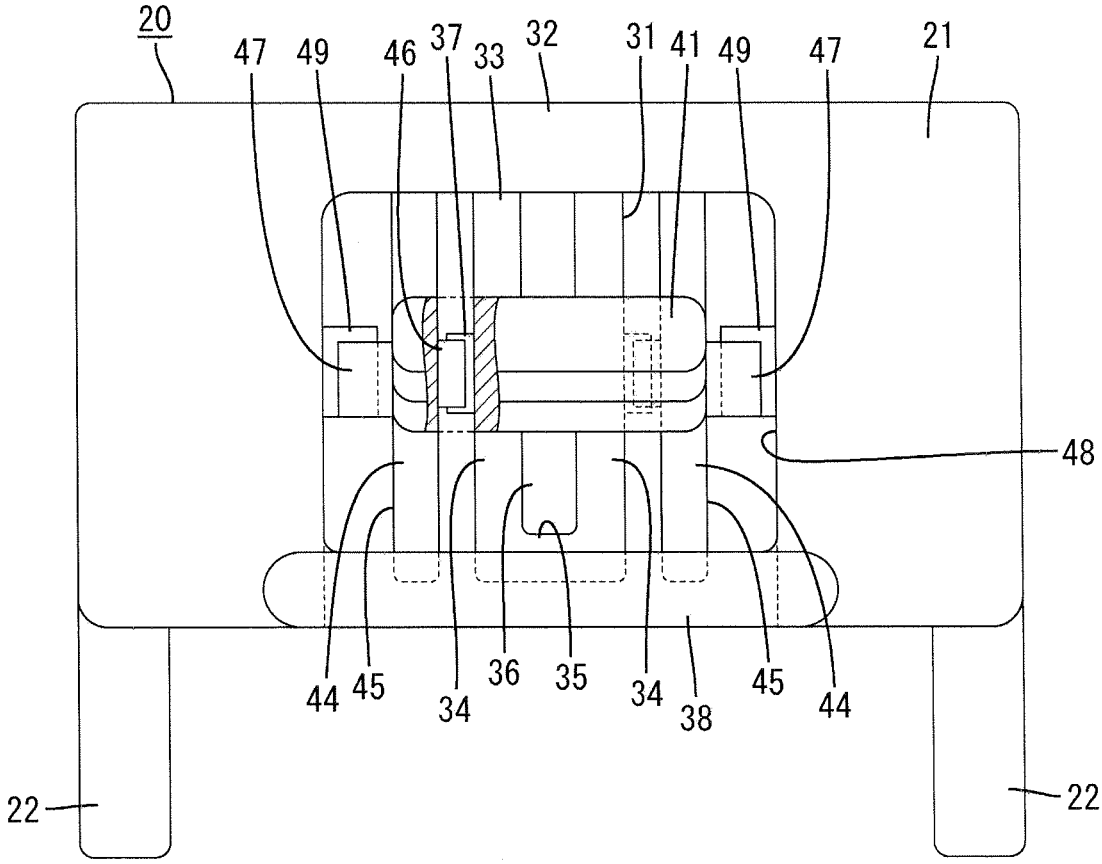
FIG. 8 is a plan view of the lever.

As shown in FIG. 8, the operation part 21 is substantially square in a plan view and has a lever-locking part 31 spaced from the arms 22. A rear beam 32 is formed at the rear end of the operation part 21 in the rotational direction of the lever 20. The lever-locking part 31 includes an elastic piece 33 that is cantilevered forward from the rear beam 32 so that the elastic piece 33 can deform elastically in and out about the rear beam 32. The elastic piece 33 has parallel left and right legs 34 that extend forward from the rear beam 32 and a lock 35 that connects front ends of the legs 34 to each other near the front end of the operation part 21. A lever-locking hole 36 penetrates through the elastic piece 33 at a position between the legs 34 and rearward of the lock 35. The lever-locking hole 36 can receive the receiving projection 76 of the receiving portion 72 from the outside.

Left and right elastic piece interlocking portions 37 project out from the outer surfaces of the legs 34. A rib-shaped front beam 38 extends along the front end of the operation part 21 in the rotational direction thereof. The free front end of the elastic piece 33 is below the front beam 38 and is covered by the front beam 38. More particularly, a part of the lock 35 overlaps the front beam 38 in the thickness direction of the operation part 21.

A release portion 41 is formed on the operation part 31 between the rear beam 32 and the lock 35. Left and right parallel supports 43 extend down from the release portion 41 and are provided at opposite sides of the elastic piece 33 so that slight gaps exist between the legs 34 and the supports 43. The release portion 41 covers and straddles an intermediate portion of the lever-locking hole 36 and both legs 34. An upper surface of the release portion 41 is stepped ascendingly in a return direction of the lever 20 to facilitate operability when an operator puts a finger on the upper surface of the release portion 41.

The supports 43 are cantilevered from the rear beam 32 and have free ends that can be flexed in and out. A front end of each support 43 is at almost the same position as the front end of the elastic piece 33 and is almost on the same level as the front end of the elastic piece 33. Trapezoidal vertical plates 45 extend from the front ends of the respective supports 43 to the rear end of the release portion 41. Each vertical plate 45 has an upgrading slope 44 that extends from the front end of the respective support 43 to the front end of the release portion 41. Left and right release portion interlocking projections 46 project inwardly from the inner surfaces of the vertical plates 45 at an upper position so that the release portion interlocking projections 46 overlap the respective elastic piece interlocking projections 37 in a direction in which the elastic piece 33 flexes. The release portion interlocking projections 46 interfere with the elastic piece interlocking projections 37 when the release portion 41 is pressed towards the elastic piece 33 to press the elastic piece interlocking projections 37 down and to guide a flexing operation of the elastic piece 33.

Left and right excessive flexure prevention pieces 47 project out from the outer surfaces of the vertical plates 45 at positions higher than the release portion interlocking projections 46. Receiving pieces 49 project in from the inner surfaces of grooves 48 (FIG. 8) that partition the lever-locking part 31. Each receiving piece 49 is at a lower position, and the receiving pieces 49 and the excessive flexure prevention pieces 47 overlap each other in a direction in which the support 43 flexes. The excessive flexure prevention pieces 47 interfere with the receiving pieces 49 when the release portion 41 is pressed excessively towards the elastic piece 33 to prevent further pressing of the release portion 41.

The arms 22 of the lever 20 are inserted into the lever accommodation spaces 70 of the housing 60 from the rear. Each covering wall 62 is flexed so that the shaft 71 of the respective covering wall 62 enters the bearing portion 24 of the corresponding arm 22. The holding piece 27 is locked to the locking step 67 of the receiving groove 66 of the main body 61 to hold the lever 20 at the initial rotational position. As a result, the straight edge 23 of the lever 20 inclines towards the rotation-finish position and the entrance of the cam groove 25 faces the fit-in surface of the housing 60. In this state, the main body 61 of the housing 60 is fit in the hood 92 of the mating housing 90 sufficiently for the cam pin 93 to enter the cam groove 25, as shown in FIG. 1. Further one of the release ribs 95 contacts the holding piece 27 and elastically deforms the holding piece 27 out of engagement with the locking step 67, thereby permitting rotation of the lever 20. The operator holds the operating part 21 of the lever 20 and rotates the lever 20 clockwise in the direction shown by the arrow of FIG. 1. As a result, the cam pin 93 moves relatively towards the inward side of the cam groove 25 and produces a cam action for moving the housing 60 and the mating housing 90 towards one another.

Figure 2:
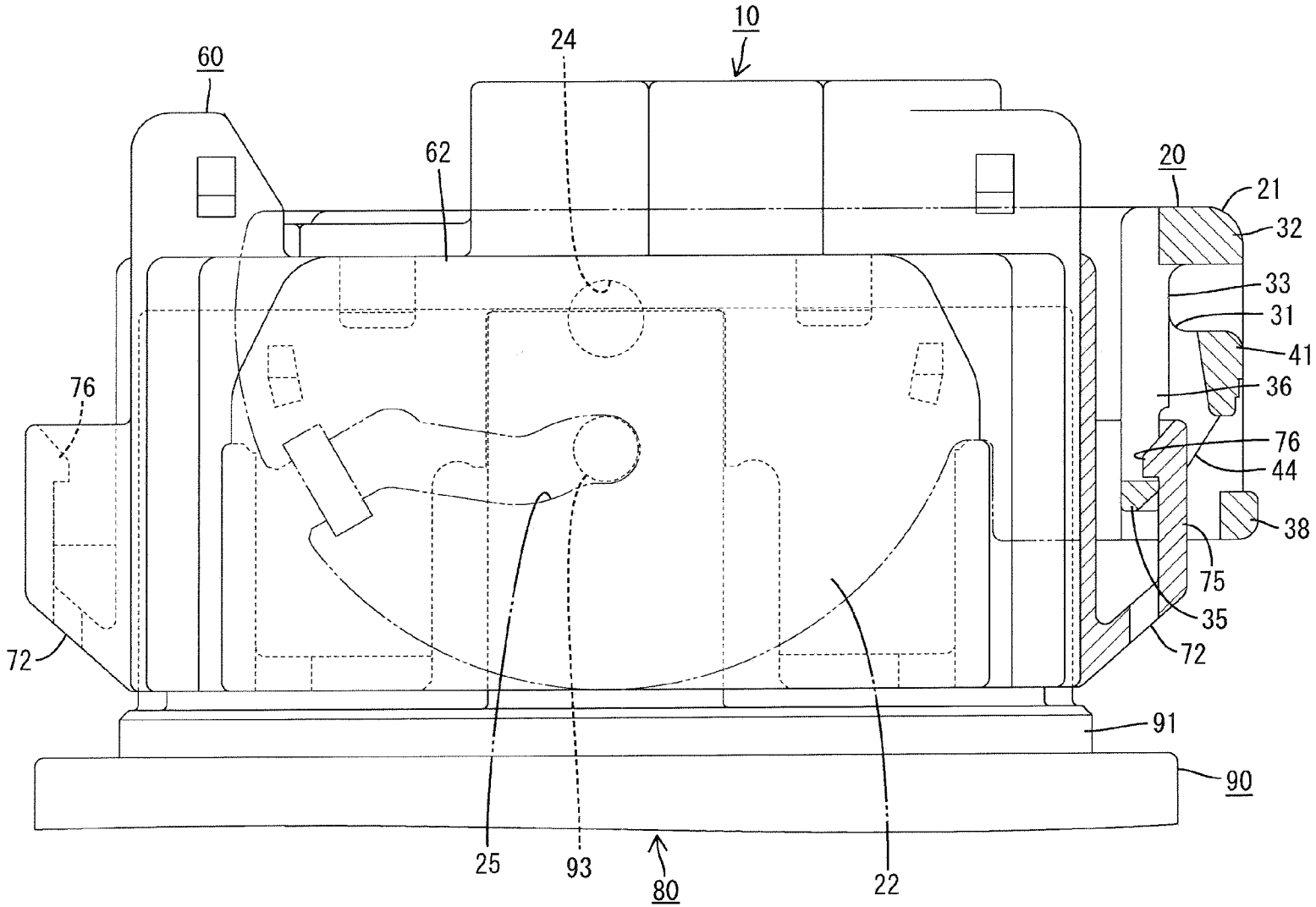
FIG. 2 is a side view, partly in section, showing the lever at a rotation-finish position, and a lock of a lever-locking part locked to a lever-lock receiving portion.
Figure 4:
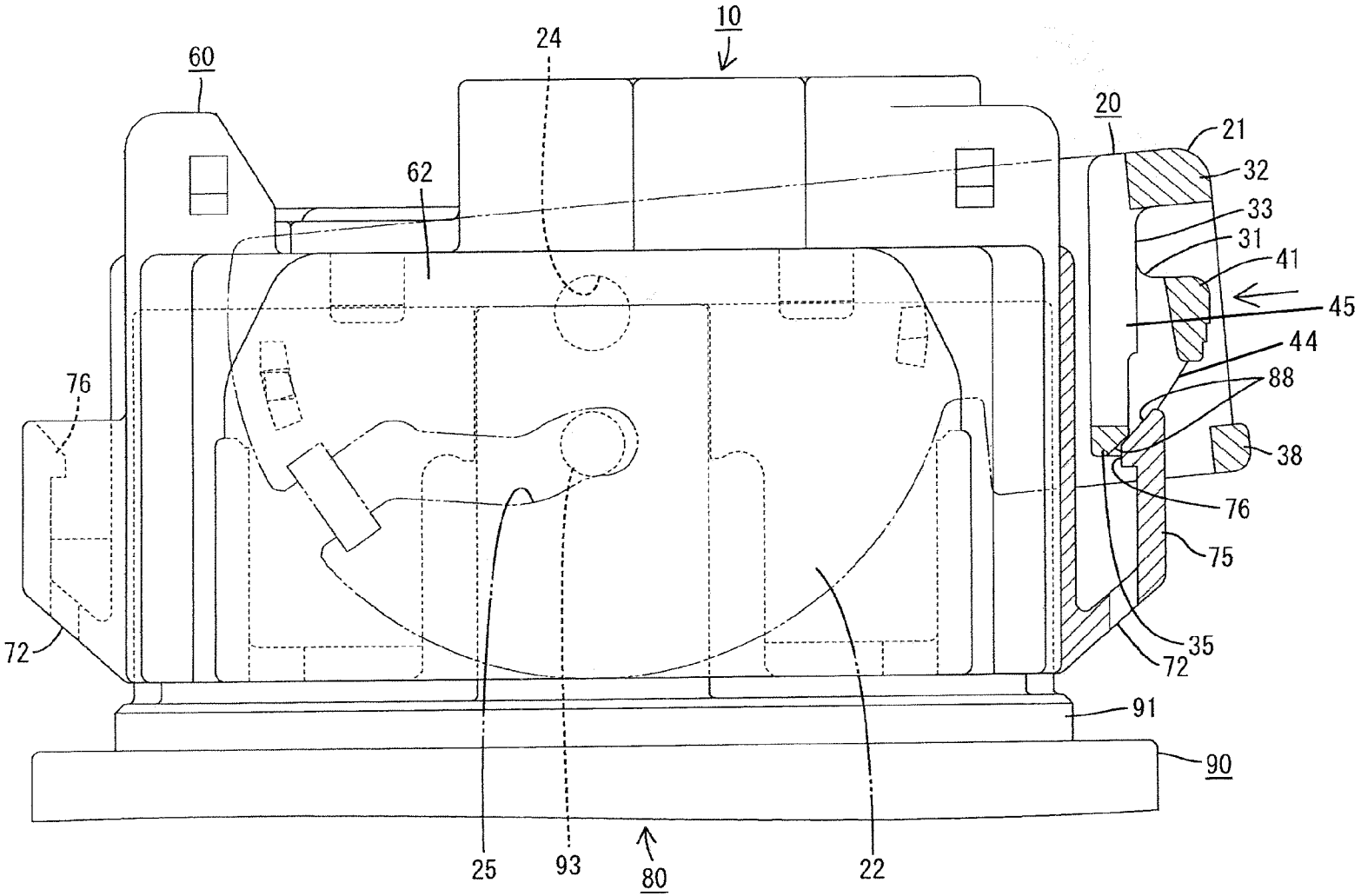
FIG. 4 is a side view, partly in section, of the housings that have been separated by rotating the lever in a return direction.

The lever-locking part 31 arrives at the lever-lock receiving portion 72 before the lever 20 reaches the rotation-finish position. As a result, the lock 35 of the elastic piece 33 interferes with the receiving projection 76 of the receiving piece 75, as shown in FIG. 4, and the elastic piece 33 is deformed elastically down so that the elastic piece 33 separates from the release portion 41. The release portion 41 is not connected with the elastic piece 33. Thus, the release portion 41 does not follow the elastic deformation of the elastic piece 33. When the lever 20 has reached the rotation-finish position, as shown in FIG. 2, the holding piece 27 is fit in the concavity 68, the lock 35 rides across the receiving projection 76, the elastic piece 33 elastically returns to its original state, the receiving projection 76 fits in the lever-locking hole 36 of the elastic piece 33, and the lock 35 and the receiving projection 76 are locked together. Thus, rotation of the lever 20 in a return direction is prevented. The cam pin 93 reaches the inward end of the cam groove 25 when the lever 20 has reached the rotation-finish position, and the main body 61 is fit in the hood 92 to a normal depth. Thus, female and male terminal fittings are connected electrically to each other.

Figure 3:
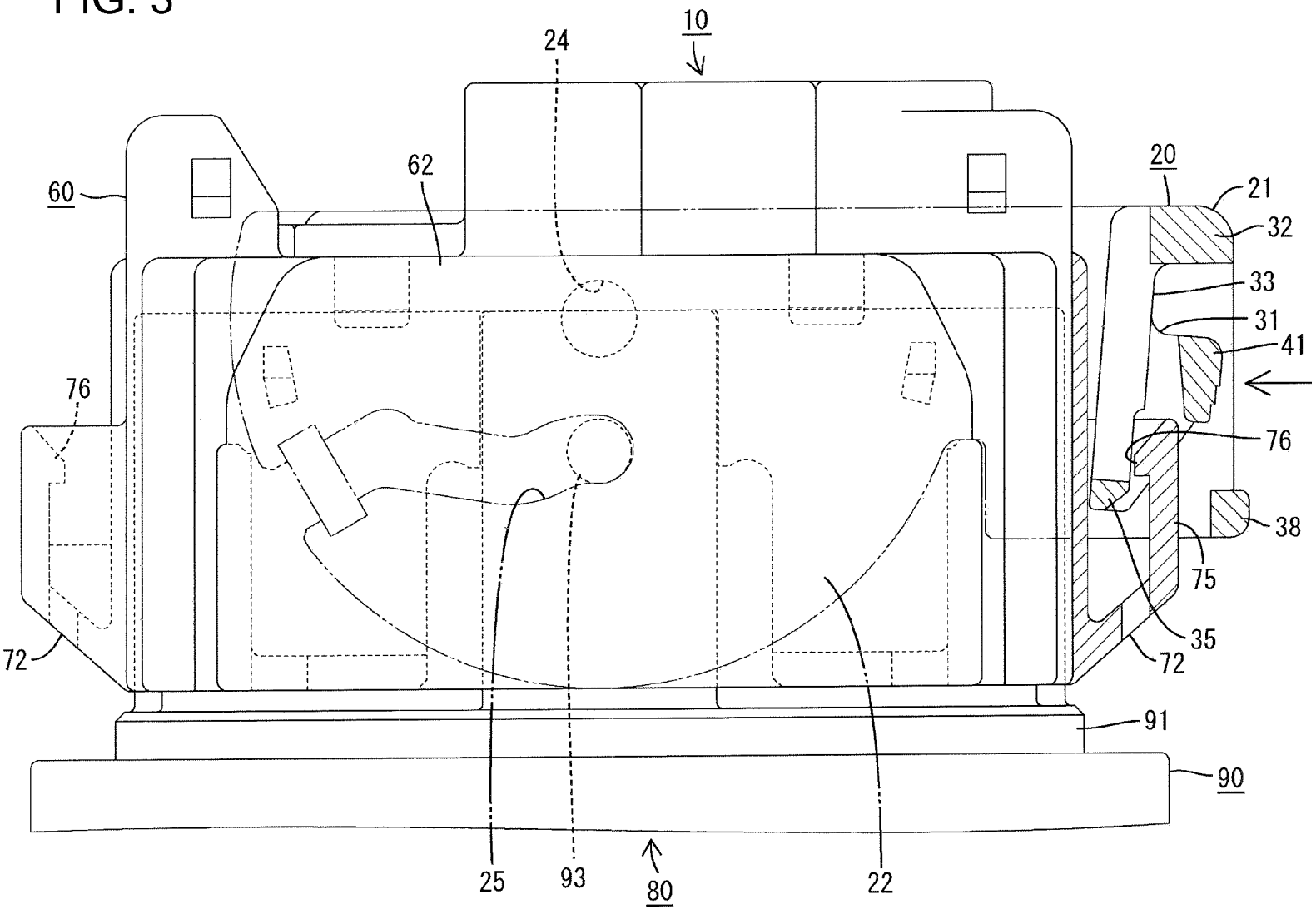
FIG. 3 is a side view, partly in section, showing the lock that has been separated from the lever-lock receiving portion by pressing a release portion.

A pressing force is imparted to the release portion 41 in a direction shown with an arrow of FIG. 3 to separate the connectors 10 and 80 for maintenance or the like. Thereafter with the support 43 being flexed, the release portion 41 is displaced toward the elastic piece 33. The release portion interlocking projection 46 contacts the elastic piece interlocking projection 37 as the release portion 41 is displaced. The release portion interlocking projection 46 presses the elastic piece interlocking projection 37 down as the release portion is pressed further. As a result, the elastic piece 33 deforms elastically down. The lock 35 separates from the receiving projection 76 when the elastic piece 33 is deformed a predetermined amount. Thus the lever-lock receiving projection 76 is unlocked from the lock 35 to permit the lever 20 to rotate in the return direction. A front-end slope 88 of the lock 35 and that of the receiving projection 76 slide with each other, as shown in FIG. 4, as the lever 20 is rotated in the return direction to separate the housings 60 and 90 from each other.

The release portion 41 of the lever-locking part 31 is between the rear beam 32 and the lock 35. Thus, the entire length of the lever-locking part 31 is shortened, as compared with the case in which the rear beam 32, the lock 35, and the release portion 41 are arranged in a row.

The distance between the rear beam 32 and the lock 35 is long. Thus the flexure amount of the elastic piece 33 is obtained when the lock 35 locks the lever-lock receiving portion 72 thereto.

The lever-locking part 31 is within the range of the operation part 21. More particularly, the rear beam 32 is disposed at the rear end of the operation part 21 and the lock 35 is disposed at the front end of the operation part 21. Therefore, it is possible to obtain a sufficient flexure of the elastic piece 33 and a favorable feeling in the locking operation without making the lever 20 large.

The release portion 41 is not connected to the elastic piece 33. The release portion 41 deforms the elastic piece 33 in the unlocking direction through the release portion interlocking projection 46 and the elastic piece interlocking projection 37 between the elastic piece 33 and the release portion 41. Therefore it is possible to flex the elastic piece 33 smoothly and to design the release portion 41 and the elastic piece 33 with a high degree of freedom.

The invention is not limited to the embodiment described above with reference to the drawings. For example, the following embodiments are included in the technical scope of the invention.

The release portion may be at a position where the release portion covers the lock so that the release portion overlaps the lock in the direction in which the elastic piece flexes.

The elastic piece may be supported at opposite ends.

The lock may be provided at the intermediate portion of the elastic piece.

The receiving portion may be at the hood of the mating connector or the terminal accommodation part thereof.

The lever-locking part may be provided at the arm.

The lever may be rotatably provided on the male housing.

What is claimed is:

1. A lever-type connector comprising:

a housing capable of engaging a mating connector; and a lever rotatably supported by said housing and having a cam groove capable of engaging a cam pin on said mating connector, said cam groove and said cam pin being configured for displaying a cam action in response to rotation of said lever for moving said housing and said mating connector towards or away from each other, said lever having a lever-locking part for engaging one of said housing and said mating connector for holding said lever in at least one rotation-prevented state, said lever-locking part having an elastic piece elastically deformable around a fixed end, a lock on said elastic piece at a position spaced from said fixed end and engageable with a receiving portion on said housing or said mating connector, a release portion covering part of said elastic piece between said fixed end and said lock, said release portion being moveable against said elastic piece for displacing said elastic piece sufficiently for separating said lock from said receiving portion for permitting said lever to be rotated.

2. The lever-type connector of claim 1, wherein said release portion is not connected to said elastic piece, at least one interlocking portion provided between said elastic piece and said release portion for flexing said elastic piece in an unlocking direction in response to a pressing force on said release portion.

3. The lever-type connector of claim 2, wherein the at least one interlocking portion comprises at least one elastic piece interlocking portion on the elastic piece and at least one release portion interlocking portion on the release portion.

4. The lever-type connector of claim 1, wherein said lever comprises at least one arm having said cam groove, and an operation part disposed at an end of said arm, said lever-locking part being formed on said operation part, said fixed end being at one end of said operation part in a rotational direction of said lever, and said lock being substantially at end of said operation part opposite the fixed end with respect to said rotational direction.

5. The lever-type connector of claim 4, wherein the at least one arm comprises two parallel arms extending from opposite ends of the operation part.

6. The lever-type connector of claim 5, wherein the at least one cam groove comprises two cam grooves formed respectively in said arms.

7. The lever-type connector of claim 1, further comprising substantially parallel resiliently deflectable first and second supports disposed on opposite respective sides of the elastic piece, the release portion extending between the supports and straddling the elastic piece.

8. The lever-type connector of claim 1, wherein the receiving portion of the housing includes a resiliently deflectable receiving piece with a receiving projection for locked engagement with the lock of the lever.

* * * * *